US006715579B1

(12) United States Patent
Hendron

(10) Patent No.: US 6,715,579 B1
(45) Date of Patent: Apr. 6, 2004

(54) ARTICULATED FRAME WORK VEHICLE

(75) Inventor: Scott Svend Hendron, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/266,054

(22) Filed: Oct. 7, 2002

(51) Int. Cl.[7] ..... B60S 9/02

(52) U.S. Cl. ..... 180/764.1; 180/766.1; 212/302; 212/304

(58) Field of Search ..... 280/763.1, 764.1, 280/765.1, 766.1; 212/301–305

(56) References Cited

U.S. PATENT DOCUMENTS

| | | | | |
|---|---|---|---|---|
| 3,777,898 A | * | 12/1973 | Gallay | 212/304 |
| 4,260,064 A | * | 4/1981 | Ekstam | 212/231 |
| 4,401,408 A | * | 8/1983 | Gibert | 414/687 |
| 4,431,363 A | * | 2/1984 | Waite | 414/687 |
| 4,555,031 A | * | 11/1985 | Blase et al. | 212/302 |
| 5,961,145 A | * | 10/1999 | Schillinger et al. | 280/764.1 |

OTHER PUBLICATIONS

Kubota Brochure; "Wheel Loader R400–R400B"; 10 pages; Printed in Japan 1987.

* cited by examiner

*Primary Examiner*—Lesley D. Morris
*Assistant Examiner*—L. Lum

(57) ABSTRACT

A work vehicle is provided with an articulated frame having a first frame segment and a second frame segment that are pivotally coupled to one another by a vertical pivot. An actuator is coupled to the frame segments for articulating the segments relative to one another to steer the vehicle. Each frame segment is provided with ground engaging wheels which support the respective frame segments. A work implement in the form of a backhoe is mounted to the second frame segment. A stabilizer having two stabilizer arms is mounted to the first frame segment. The stabilizer arms have a work position and a transport position. In its work position the stabilizer arms are lowered and the ground engaging wheels of the second frame segment are lifted off the ground. The actuator for steering the vehicle can then be used to pivot the backhoe about a vertical axis defined by the vertical pivot.

16 Claims, 3 Drawing Sheets

ARTICULATED FRAME WORK VEHICLE

FIELD OF THE INVENTION

The present invention is directed to an articulated frame work vehicle wherein the steering articulation is used to pivot a work implement relative to one frame segment that is mounted on the other frame segment.

BACKGROUND OF THE INVENTION

Work vehicles for performing a work operation can be generally divided into rigid frame work vehicles and articulated frame work vehicles. Rigid frame work vehicles typically have a steerable axle that pivots in relation to the vehicle frame to steer the vehicle. Tracked vehicles are typically rigid frame work vehicles that are steered by driving the tracks at different speeds. Articulated frame work vehicles typically include two frame segments that are pivotally coupled to one another about a vertical pivot. Each frame segment is provided with ground engaging wheels and/or tracks for supporting the respective frame segment.

A backhoe loader is a work vehicle having a loader mounted to the front of the vehicle and a backhoe mounted to the rear of the vehicle. The loader comprises two loader arms that are pivotally coupled to the vehicle and a loader bucket that is pivotally coupled to the loader arms. The backhoe comprises a swing frame that is pivotally mounted to the vehicle, a boom that is pivotally mounted to the swing frame, a dipperstick that is pivotally coupled to the boom, and a bucket that is mounted to a tool coupler on the dipperstick. Stabilizer arms extend from the frame of the vehicle to stabilize the frame of the vehicle during a backhoe operation. Backhoe loaders can be rigid frame or articulated machines.

SUMMARY

A work vehicle for performing a work operation comprises an articulated frame having a first frame segment and a second frame segment that are pivotally coupled to one another by a vertical pivot. An actuator is coupled to the frame segments for articulating the segments relative to one another to steer the vehicle. Each frame segment is provided with ground engaging wheels which support the respective frame segment. A work implement in the form of a backhoe is mounted to the second frame segment. A second work implement in the form of a loader may be mounted to the first frame segment. A stabilizer comprising two stabilizer arms is mounted to the first frame segment. The stabilizer arms have a work position and a transport position. In its work position the stabilizer arms are lowered and the ground engaging wheels of the second frame segment are lifted off the ground. The actuator for steering the vehicle can then be used to pivot the backhoe about a vertical axis defined by the vertical pivot. In the transport position the stabilizer arms are lifted out of the way. The ground engaging wheels of the second frame segment are smaller than the ground engaging wheels of the first frame segment.

DETAILED DESCRIPTION

Figure 1:
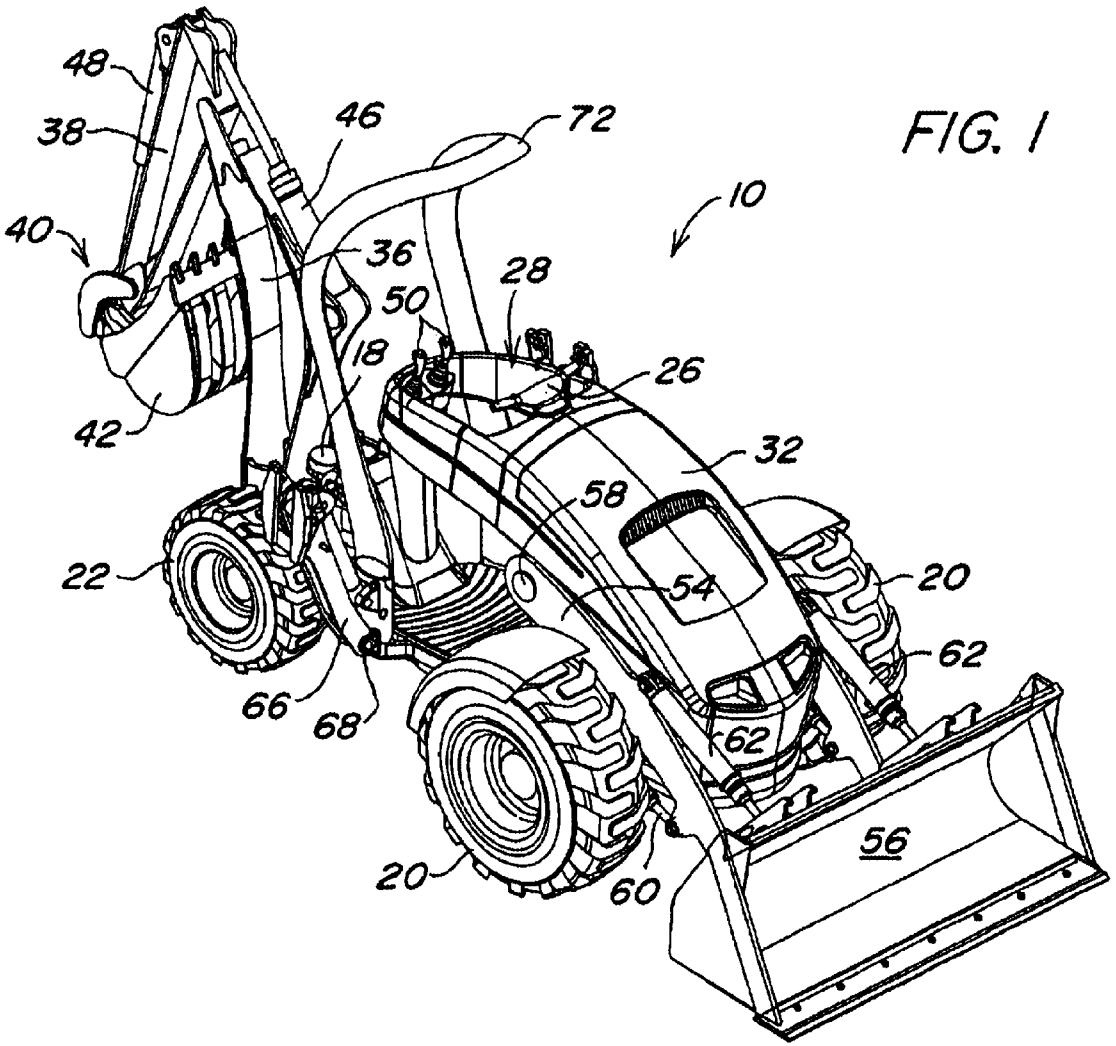
FIG. 1 is a front perspective view of the articulated frame work vehicle.

A work vehicle 10 having an articulated frame 12 is illustrated in FIG. 1. The articulated frame 12 comprises a first frame segment 14 and a second frame segment 16. The first and second frame segments 14 and 16 are coupled to one another by a vertical pivot 18 defining a predominantly vertical steering axis. The first frame section 14 is provided with a first set of ground engaging wheels 20 for supporting the first frame segment 14. The second frame segment 16 is provided with a second set of ground engaging wheels 22 for supporting the second frame segment 16. Although the frame segments 14 and 16 of the illustrated work vehicle are shown as being supported on ground engaging wheels 20 and 22, these frame segments 14 and 16 could also be supported on ground engaging tracks, arranged in either a four track configuration or a half track configuration (two tracks-two wheels).

An actuator 24 pivots the first and second segments 14 and 16 relative to one another to steer the vehicle 10. The operator steers the vehicle by manipulating steering handle 26 located in operator's station 28. The operator's station 28 is located on the first frame segment 14. In the illustrated embodiment, the actuator 24 is a linear actuator, in the form of a double acting hydraulic cylinder, however rotary actuators may also be used, or electrically or pneumatically driven linear actuators.

The vehicle 10 is driven by an internal combustion engine and transmission, not shown, located under the hood 32 of the first frame segment 14. The engine and transmission drive the first set of wheels 20. A telescoping drive shaft could be extended to the second set of ground engaging wheels 22 to also drive these wheels in a four wheel drive configuration. Other drive arrangements could also be employed for propelling the vehicle in a two wheel drive or four wheel drive configuration including electrical or hydraulic driven wheel motors.

The second frame segment 16 is provided with a work implement in the form of the illustrated backhoe 34. The illustrated backhoe 34 comprises a boom 36, a dipperstick 38, a tool coupler 40 and a bucket 42. The boom 36 is pivotally coupled to the second frame segment 16 about a boom pivot, not shown, having a predominantly horizontal pivot axis that is transverse to the orientation of the second frame segment 16. The boom 36 is pivoted about the boom pivot by boom hydraulic cylinder 45. The dipperstick 38 is pivotally coupled to the boom 36, at the end of the boom 36 remote from the boom pivot, by a dipperstick pivot 44. The dipperstick 38 is pivoted about the dipperstick pivot 44 by dipperstick hydraulic cylinder 46. The end of the dipperstick 38 remote from the dipperstick pivot 44 is provided with the tool coupler 40. The tool coupler 40 is manipulated by tool coupler hydraulic cylinder 48. In the illustrated embodiment, a bucket 42 is mounted to the tool coupler 40, but other tools could also be mounted to the tool coupler 40 including jack hammers, rollers, grapples and other suitable tools. The operation of the backhoe is controlled by control levers 50 located in the operator's station 28. Although the work implement is illustrated as a backhoe, it could also comprise a crane or similar work implement.

The first frame segment 14 is provided with a second work implement in the form of the illustrated loader 52. The loader 52 comprises two loader arms 54 and a loader bucket 56. The loader arms 54 are pivotally coupled to the first frame segment 14 by loader arms pivots 58. The arms 54 are pivoted relative to the first frame segment 14 by loader arm hydraulic cylinders 60. The loader bucket 56 is pivotally coupled to the end of the loader arms 54 remote from the loader arm pivots 58. The loader bucket 56 is manipulated by loader bucket hydraulic cylinders 62. Although the illustrated embodiment discloses a loader bucket, other work tools, such as, a bull dozer blade, a pavement grinding drum, a grapple bucket or a side dumping loader bucket may be mounted to the loader arms 54.

A stabilizer 64 is the form of right and left stabilizer arms 66 are coupled to the first frame segment 14. The stabilizer 64 has a work position and a transport position. The stabilizer 64 is placed in its work position when the operator is operating the work implement mounted to the second frame segment 16. In its work position the stabilizer 64 lifts the second set of ground engaging wheels 22 off the ground. With the second set of ground engaging wheels 22 lifted off the ground, the second frame segment 16 and attached work implement is pivoted about the vertical steering axis through the manipulation of the actuator 24. Therefore the vertical work implement pivot axis is coaxial with the steering pivot axis.

Figure 2:
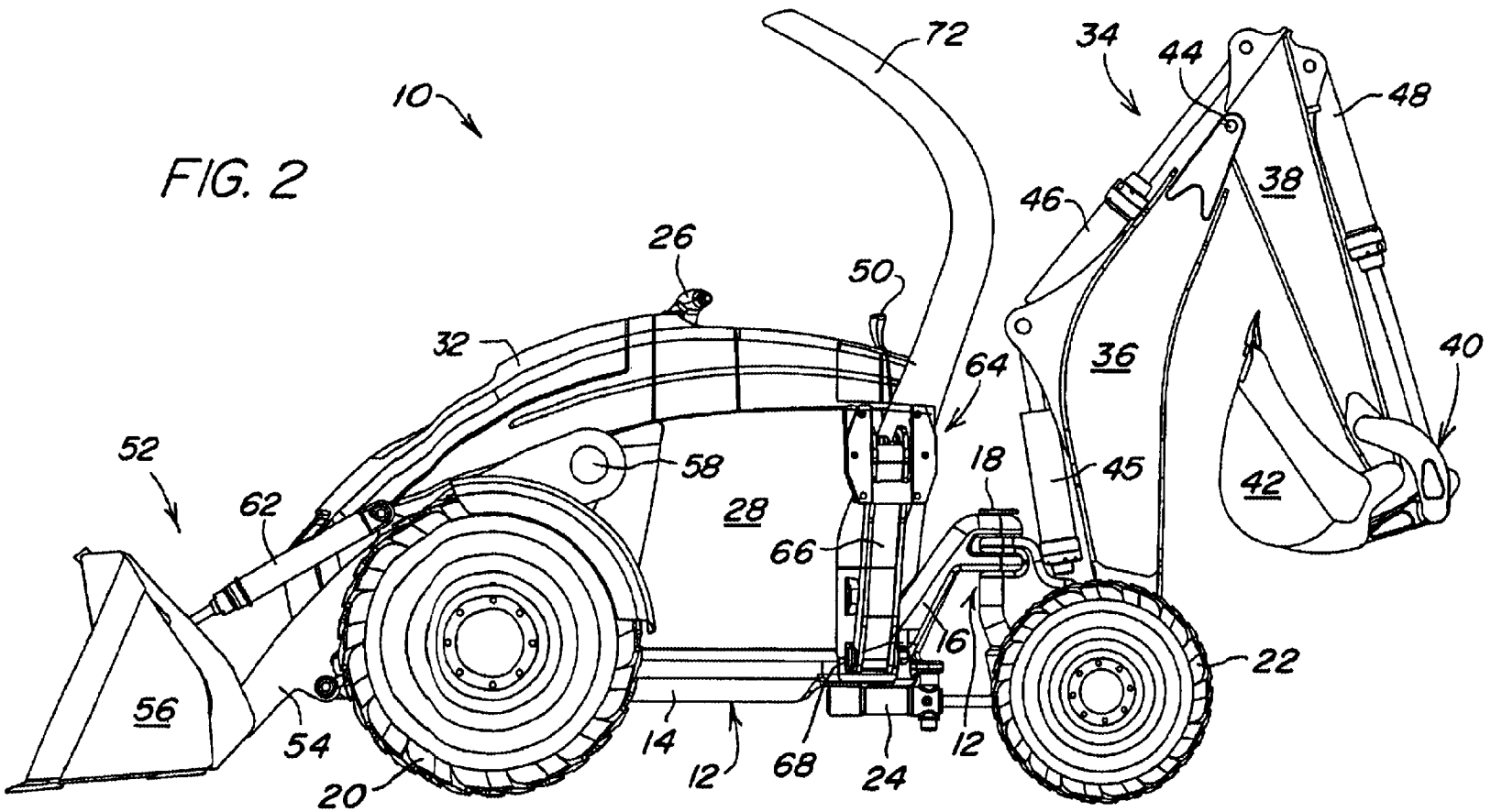
FIG. 2 is a side view of the articulated frame work vehicle.
Figure 3:
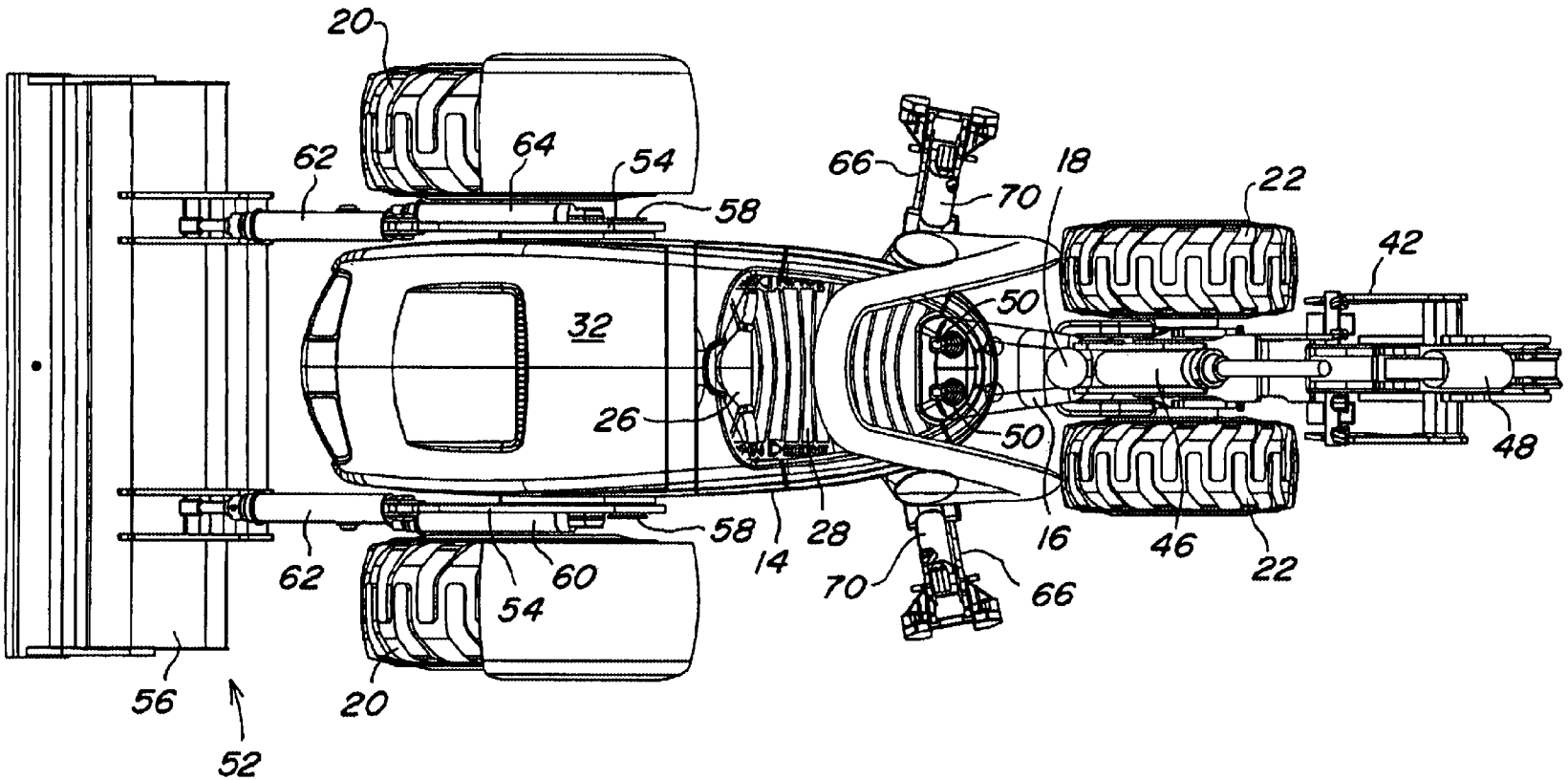
FIG. 3 is a top view of the articulated frame work vehicle.

The stabilizer arms 66 are pivotally coupled to the first frame segment 14 by stabilizer arm pivots 68. The positioning of the stabilizer arms 66 is controlled by stabilizer arm hydraulic cylinders 70. In the stabilizer's transport position these arms 66 are raised so they do not interfere with driving the vehicle. The transport position is illustrated in FIGS. 1–3. It should be noted that other stabilizer arrangements could be used including side shift frames.

In the illustrated embodiment, the second set of ground engaging wheels 22 are smaller than the first set of ground engaging wheels 20. The second set of wheels 22 are smaller to better accommodate the stabilizer arms 66 and locate them closer to the second frame 16 while still maintaining adequate clearance.

The illustrated operator's station 28 is shown as being an open stand up position. However, the operator's station 28 could be enclosed and provided with a seat. In addition, the illustrated operator's station 28 is provided with a roll bar 72.

The current invention should not be limited by the above described embodiment, but should be limited solely by the claims that follow.

What is claimed is:

1. A work vehicle for performing a work operation, the work vehicle comprising:

an articulated frame having a first frame segment and a second frame segment, the first and second frame segments are pivotally coupled to one another by a pivot the pivot defining a predominantly vertical axis;

a linear actuator extends between the first frame segment and the second frame segment for articulating the first and second frame segments relative to one another to steer the work vehicle;

a first set of wheels extending from the first frame segment and a second set of wheels extending from the second frame segment;

a work implement is mounted to the second frame segment;

a stabilizer is mounted to the first frame segment, the stabilizer having a work position and a transport position, in the work position the stabilizer lifts the second set of wheels off the ground and the first set of wheels remain in contact with the ground.

2. A work vehicle as defined by claim 1 wherein the linear actuator comprises a double acting hydraulic cylinder which articulates the first and second frame segments to steer the work vehicle.

3. A work vehicle as defined by claim 1 the stabilizer composes right and left stabilizer arms.

4. A work vehicle as defined by claim 3 wherein the left and right stabilizer arms are pivotally coupled to the first frame segment.

5. A work vehicle as defined by claim 4 wherein the work implement comprises a boom being pivotally coupled to the second frame segment.

6. A work vehicle as defined by claim 5 wherein the first frame segment is provided with a second work implement.

7. A work vehicle as defined by claim 6 wherein the second work implement comprises a loader having loader arms and a loader bucket.

8. A work vehicle as defined by claim 5 wherein the work implement further comprises a dipperstick being pivotally coupled to the boom, the dipperstick being provided with a tool coupler.

9. A work vehicle as defined by claim 6 wherein the work implement further comprises a bucket coupled to the tool coupler.

10. A work vehicle as defined by claim 1 wherein the second set of wheels is smaller than the first set of wheels.

11. A work vehicle for performing a work operation, the work vehicle comprising:

an articulated frame having a first frame segment and a second frame segment, the first and second frame segments are pivotally coupled to one another by a predominantly vertical pivot;

a linear actuator extends between the first frame segment and the second frame segment for articulating the first and second frame segments relative to one another to steer the work vehicle;

first means for engaging the ground and supporting the first frame segment and a second means for engaging the ground and supporting the second frame segment;

a work implement is mounted to the second frame segment;

a stabilizer is mounted to the first frame segment, the stabilizer having a work position and a transport position, in the work position the stabilizer lifts the second means off the ground and the first set of wheels remain in contact with the ground.

12. A work vehicle as defined by claim 11 the stabilizer comprises right and left stabilizer arms.

13. A work vehicle as defined by claim 12 wherein the work implement comprises a backhoe having a boom pivotally coupled to the second frame segment, a dipperstick pivotally coupled to the boom and having a tool coupler and a bucket mounted to the tool coupler.

14. A work vehicle as defined by claim 13 wherein the first frame segment is provided with a loader having loader arms and a loader bucket.

15. A method of operating a work vehicle having a first frame segment and a second frame segment that are pivotally coupled to one another by a pivot, an actuator engages the first frame segment and the second frame segment for pivoting the frame segments relative to one another about the pivot to steer the work vehicle, the first frame segment having a first set of ground engaging wheels and the second frame segments having a second set of ground engaging wheels, the first frame segment having a stabilizer and the second frame segment having a work implement, the method comprising the following steps:

actuating the stabilizers to lift the second set of ground engaging wheels off the ground and keep the first set of ground engaging wheels in contact with the ground;

manipulating the actuator to pivot the second frame segment relative to the first frame segment to move the work implement relative to the first frame segment.

16. A work vehicle for performing a work operation, the work vehicle comprising:

an articulated frame having a first frame segment and a second frame segment, the first and second frame segments are pivotally coupled to one another by a predominantly vertical pivot defining a steering pivot axis;

first means for engaging the ground and supporting the first frame segment and a second means for engaging the ground and supporting the second frame segment;

a work implement is mounted to the second frame segment and has a work implement pivot axis that is coaxial with the steering pivot axis;

a stabilizer is mounted to the first frame segment, the stabilizer having a work position and a transport position, in the work position the stabilizer lifts the second means off the ground and the first means remains in contact with the ground.

* * * * *